US010709169B1

(12) United States Patent
Richmond et al.

(10) Patent No.: US 10,709,169 B1
(45) Date of Patent: Jul. 14, 2020

(54) CONICAL PAPER FABRICATOR

(71) Applicant: Banana Bros, LLC, Culver City, CA (US)

(72) Inventors: David Richmond, Culver City, CA (US); Howard Richmond, Los Angeles, CA (US); Manuel A. Montano, Gardena, CA (US); Jeffery Kunkler, Culver City, CA (US)

(73) Assignee: Banana Bros, LLC, Culver City, CA (US)

( * ) Notice: Subject to any disclaimer, the term of this patent is extended or adjusted under 35 U.S.C. 154(b) by 0 days.

(21) Appl. No.: 16/425,789

(22) Filed: May 29, 2019

(51) Int. Cl.

| | |
|---|---|
| ***A24C 5/44*** | (2006.01) |
| ***A24C 5/46*** | (2006.01) |
| ***A24D 1/02*** | (2006.01) |

(52) U.S. Cl.
CPC ..... *A24C 5/44* (2013.01); *A24C 5/465* (2013.01); *A24D 1/025* (2013.01)

(58) Field of Classification Search
CPC ..... A24C 5/46; A24C 5/465; A24C 1/26–30; A24C 1/34; A24C 5/10; A24C 5/40; A24C 5/44; B31C 7/00; B31C 7/02; B31C 7/08; B65B 41/06; B65B 11/10; B65B 11/48; B65B 9/023; B65B 19/22–34
See application file for complete search history.

(56) References Cited

U.S. PATENT DOCUMENTS 4,158,989 A * 6/1979 Barr ..... B31C 7/02 493/108

* cited by examiner

*Primary Examiner* — Michael H. Wilson
*Assistant Examiner* — Yana B Krinker
(74) *Attorney, Agent, or Firm* — Smyrski Law Group, A P.C.

(57) ABSTRACT

An apparatus for rolling papers into a non-cylindrical orientation is provided. The apparatus includes a rotatable non-cylindrical workpiece having a plurality of openings provided therein, a surface comprising a receiving indentation configured to receive and fit the rotatable non-cylindrical workpiece, a suction producing arrangement connected to the rotatable non-cylindrical workpiece, and a rolling paper. The suction producing arrangement draws air through the plurality of openings while the rotatable non-cylindrical workpiece rotates such that the drawn air draws the rolling paper toward and around the rotatable non-cylindrical workpiece, the rotation causing the rolling paper and a quantity of adhesive applied to the rolling paper to form a completed non-cylindrical rolling paper product.

20 Claims, 5 Drawing Sheets

CONICAL PAPER FABRICATOR

BACKGROUND

I. Field

The present invention relates generally to smokable products, and more particularly, to preparing papers or external covering materials of irregular shape used in producing a smokable product.

II. Background

People have adopted the practice of smoking, where plant matter containing phytochemicals, such as tobacco or cannabis, is burned to produce inhalable smoke. Humans have created several devices to facilitate smoking, such as pipes or hookahs, but many prefer the convenience and experience of smoking a cigarette, which is produced by wrapping plant matter in a thin piece of paper rolled into a tube.

Pre-manufactured tobacco cigarettes are readily accessible to consumers in packs or cartons sold at stores around the world, however, many individuals prefer to roll their tobacco cigarettes for a number of reasons. Some prefer to roll their cigarettes because it is less expensive to purchase loose tobacco and wrapping paper than to purchase pre-manufactured cigarettes. Some individuals prefer to roll their own cigarettes to ensure that their cigarettes are free of unwanted additives and chemicals and to have greater control over the strain of cannabis used to make the cigarette. Hand rolled cannabis cigarettes are frequently less expensive than their pre-manufactured counterparts.

An individual may create a hand-rolled cigarette by first placing loose plant matter, such as tobacco or cannabis, stock onto a sheet of rolling paper and then using his or her fingertips to wrap and seal the paper around the plant matter. An optional filter or crutch may then be placed on either end of the cigarette to enhance the smoking experience. Unfortunately, a hand-rolled cigarette's quality depends greatly on the preparer's skill and experience, and producing a cigarette with uniform plant matter density can be challenging. Uneven packing can result in an unevenly burning cigarette with a harsher and less enjoyable smoking experience.

Certain wrapping papers are available that have been rolled by hand into a conical or cylindrical shape that may include a crutch or a filter (known in certain instances as a "pre-roll paper" or "pre-rolled paper," used interchangeably herein). Each hand rolled pre-roll paper has one open end in which an individual may fill the pre-roll paper with plant matter to produce a cigarette. Pre-roll papers, as well as machines used to roll cigarettes, are available and offer alternatives to the user hand-rolling a single cigarette, but both alternatives are inefficient for large-scale cigarette production. Both alternatives often fail to yield consistency among the cigarettes they produce, with the risk of an uneven burn. Pre-roll papers, while available, are believed to be universally produced by hand rolling.

Further, the papers used for cannabis cigarettes are generally conical in shape rather than cylindrical, and thus traditional cigarette paper rolling machines that roll cylindrical papers do not work well with cannabis rolling papers. Further, the papers associated with cannabis tend to be thinner than papers used in rolling cigarettes. Cigarette papers can vary, but are generally on the order of 0.003 inches thick, or three one thousandths of an inch in thickness, and has a weight of approximately between 12 and 13 $g/m^2$ for the thinnest cigarette papers. Rolling papers employed with cannabis tend to be on the order of 10 $g/m^2$, and sometimes less. Aside from the fact that cigarette machines cannot produce conical shaped paper rolls for cannabis, a cigarette machine rolling cylindrical shaped cigarettes using the thinner cannabis paper typically would result in tears, losses, and delays.

Cannabis legalization is becoming more common around the world and in many places in the United States. Legal statutes now permit both recreational uses of cannabis, and the demand for cannabis-filled cigarettes continues to increase as the legal market size continues to grow. To meet the demand for cannabis-filled cigarettes, cannabis cultivators have begun filling pre-rolled papers with cannabis to produce cannabis cigarettes referred to as "Pre-Rolls" that consumers may then purchase to avoid the need to produce their own cannabis cigarettes. But again, the papers in such Pre-Rolls are typically rolled by hand.

It would be beneficial to provide a product that provides a reliable and relatively quick way to provide rolled, complete cannabis papers including the optional components discussed, using relatively thin papers, without the delay inherent in hand rolling such papers. Such a design that overcomes issues with prior designs would be beneficial, and thus improve the production and distribution of such products.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its sole purpose is to present some concepts in a simplified form as a prelude to the more detailed description that is presented later.

According to one aspect of the present design, there is provided an apparatus for rolling papers into a non-cylindrical orientation. The apparatus includes a rotatable non-cylindrical workpiece having a plurality of openings provided therein, a surface comprising a receiving indentation configured to receive and fit the rotatable non-cylindrical workpiece, a suction producing arrangement connected to the rotatable non-cylindrical workpiece, and a rolling paper. The suction producing arrangement draws air through the plurality of openings while the rotatable non-cylindrical workpiece rotates such that the drawn air draws the rolling paper toward and around the rotatable non-cylindrical workpiece, the rotation causing the rolling paper and a quantity of adhesive applied to the rolling paper to form a completed non-cylindrical rolling paper product.

According to a further aspect of the present design, there is provided an apparatus for rolling papers into a non-cylindrical orientation, comprising a rotatable non-cylindrical workpiece having a plurality of openings provided therein, wherein the rotatable non-cylindrical workpiece is generally frustrum shaped, a surface comprising a receiving indentation configured to receive and shaped to accommodate the rotatable non-cylindrical workpiece, a suction producing arrangement connected to the rotatable non-cylindrical workpiece, and a rolling paper. The suction producing arrangement draws air through the plurality of openings while the rotatable non-cylindrical workpiece rotates such that drawn air serves to draw the rolling paper toward and around the rotatable non-cylindrical workpiece, resulting in a leading edge of the rolling paper binding with an adhesive applied to a trailing edge of the rolling paper.

According to another aspect of the design, there is provided an apparatus for rolling papers into a non-cylindrical product, comprising a non-cylindrical workpiece having a plurality of openings formed therein, a surface comprising a receiving indentation configured to receive and shaped to accommodate the non-cylindrical workpiece, a suction producing arrangement connected to the non-cylindrical workpiece, and a rolling paper. The suction producing arrangement is configured to draw external air through the plurality of openings while the non-cylindrical workpiece rotates such that drawn air serves to draw the rolling paper toward and around the rotatable non-cylindrical workpiece, resulting in a leading edge of the rolling paper binding with an adhesive applied to a trailing edge of the rolling paper.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

In this document, the words "embodiment," "variant," and similar expressions are used to refer to particular apparatus, process, or article of manufacture, and not necessarily to the same apparatus, process, or article of manufacture. Thus, "one embodiment" (or a similar expression) used in one place or context can refer to a particular apparatus, process, or article of manufacture; the same or a similar expression in a different place can refer to a different apparatus, process, or article of manufacture. The expression "alternative embodiment" and similar phrases are used to indicate one of a number of different possible embodiments. The number of possible embodiments is not necessarily limited to two or any other quantity.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make or use the invention, and not to limit the scope of legal protection afforded the invention, which is defined by the claims and their equivalents.

The present design comprises an apparatus or method for assembling cannabis wrapping papers faster than previously known. The wrapping papers are assembled in a conical shape and thin wrapping papers, such as those having less than or equal to 10 grams per square meter of weight may be used. The system employs a means for drawing the paper to the conical shaped work piece, such as an air intake arrangement or may employ static electricity. The system is manual in one embodiment and may be automatic or partially automatic in another embodiment. Using the method and apparatus, a user can quickly and efficiently assemble wrapping papers, potentially including filters and/or crutches when desired.

According to embodiments of the present design, there is a flat surface employed with a mandrel, also called a roller or rotatable non-cylindrical workpiece, having a plurality of openings with suction applied through these openings. Paper is placed onto this flat surface and holds the paper steady, easing the activation of pregum, or application of adhesive. When the paper is ready to be rolled, the mandrel or roller, with the plurality of openings when employing suction, is oriented and presented to the paper with openings facing directly to the paper. Suction switches from holding the paper in place to application of force suction on the rotatable roller. The user may apply the suction and feed the paper, or one or both of these actions may be automated. The mandrel or roller rotates with suction applied, drawing through the holes proximate the paper, and such suction pulls the paper around the mandrel or roller.

Figure 1:
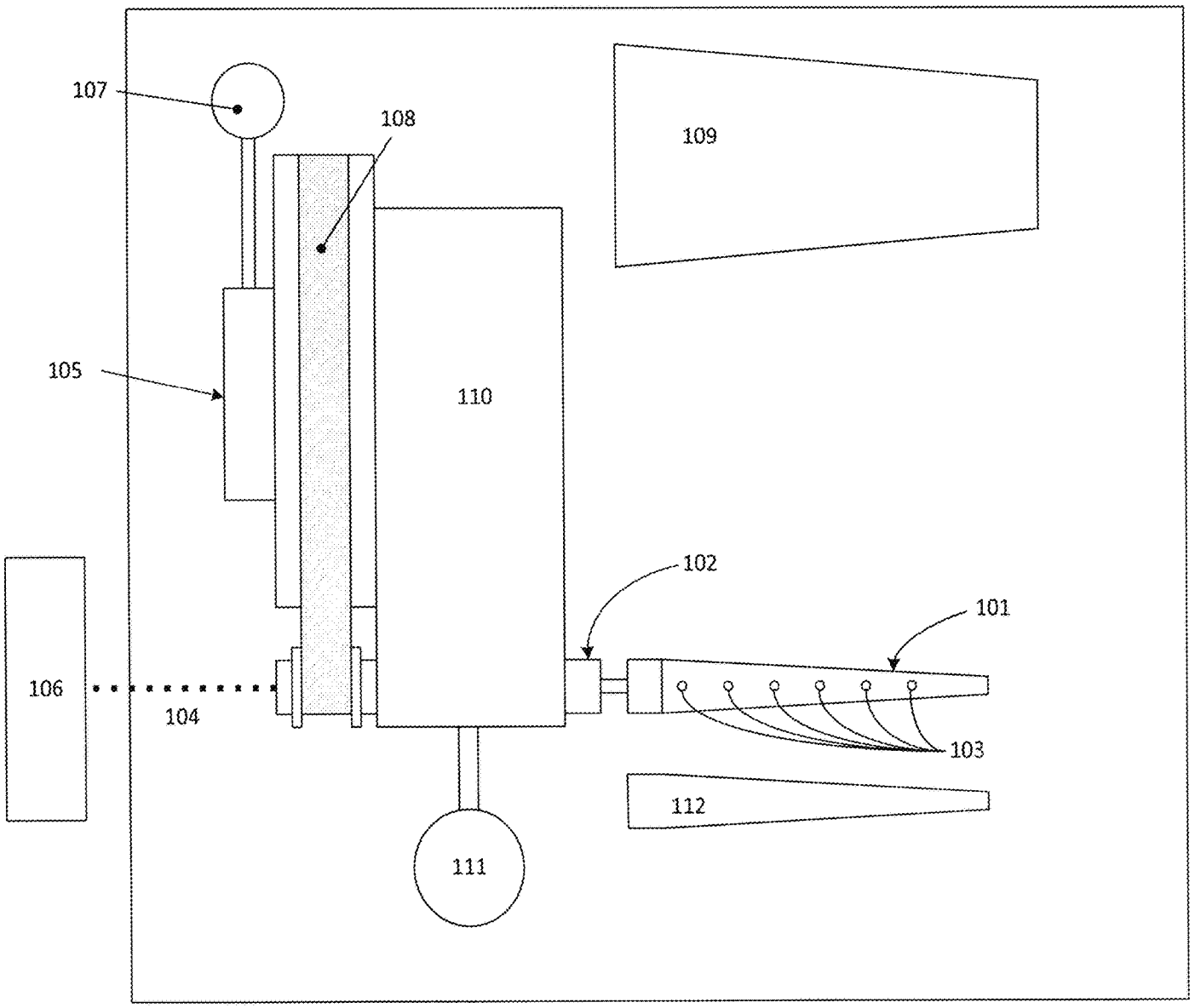
FIG. 1 is a representative top view of one aspect of the present design.

FIG. 1 is a top view of one embodiment of the machine. From FIG. 1, apparatus 100 includes a conically shaped work piece 101 joined at one end to a rotating hollow shaft 102. Holes 103 may be provided in the conically shaped work piece 101, and the conically shaped work piece 101 may be hollow as may be the rotating hollow shaft 102. In this arrangement, an optional air line 104 may be provided to the apparatus 100, such as via an inlet provided at an end of rotating hollow shaft 102. Optional air line 104 may manually or automatically be provided with suction via an attached device, shown as device 106 in FIG. 1, that creates suction through the components and through the holes 103, thereby drawing the cannabis wrapping paper toward the conically shaped work piece when operated. Operation is discussed below. The representation of FIG. 1 represents the loading configuration, and the device may be lowered into a rolling configuration.

Wheel 105 may be provided with a handle 107 if operated manually or may be turned automatically. Wheel 105 is provided with a belt 108 that engages the end of rotating hollow shaft 102. While not shown in this view, stops are provided to allow a complete turn of papers, such as 360 degrees. In one embodiment, papers are provided in a flat form in a receptacle 109, and may be picked up and placed at a position below receiving opening 112. In a typical arrangement, the papers are flat and folded and look like a portion of a circle, but other paper configurations may be provided. The papers may be folded over, such as in half. Papers are stacked in receptacle 109. Thus the operator may obtain the flat papers and apply glue to the edge of the paper. The user may then lower wheel 105 using handle 107 to a position such that the paper is positioned under the conically shaped work piece 101, or between conically shaped work piece 101 and receiving opening 112. When the device is in the lowered rolling orientation, the user may position the paper proximate conically shaped work piece 101, and operate the device as described below to roll the paper about the conically shaped work piece 101. Thus the user may either position the paper with glue applied next to the groove or receiving opening 112, or with the paper edge beneath the conically shaped work piece 101, or the user may lower the conically shaped work piece and place the paper, with glue applied, in a desired position proximate the conically shaped work piece 101.

Also shown in FIG. 1 is hinged piece 110 and hinged piece handle 111. This hinged piece 110 has a hinge component, not shown in this view, that allows the attached components such as conically shaped work piece 101 and wheel 105 to be lowered into the rolling configuration next to the work surface. Groove or receiving opening 112 receives conically shaped work piece 101, allowing for papers to be rolled around conically shaped work piece 101 when hinged piece 110 is in the rolling configuration.

Figure 2:
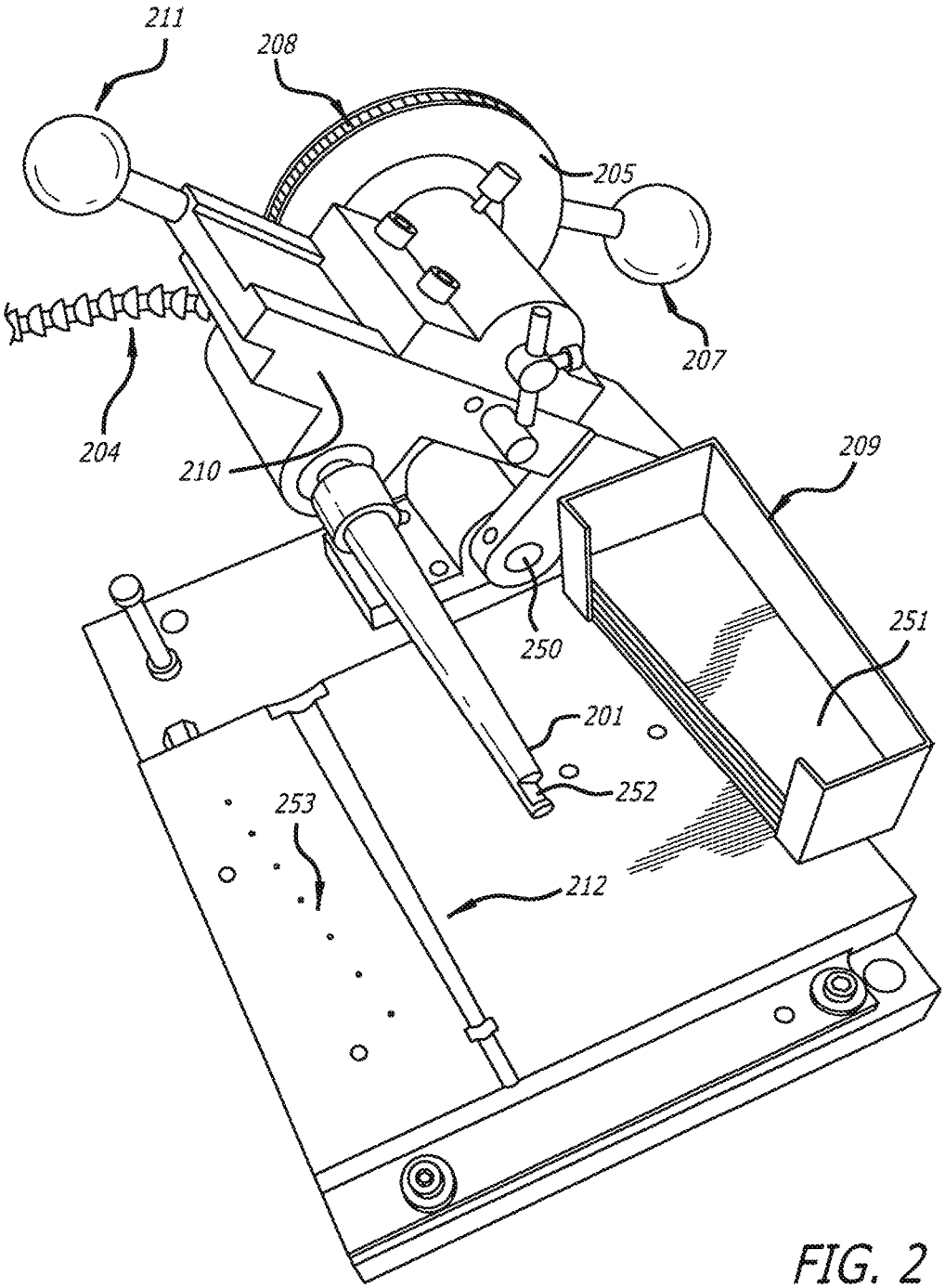
FIG. 2 is a perspective view of one aspect of the present design.

FIG. 2 is an alternate representation of the device of FIG. 1. As shown in FIG. 2, conically shaped work piece 201 is shown in a raised or working position, and holes are provided in conically shaped work piece 201. Hinged piece 210 is shown in the raised or loading configuration. Not shown in this view is the rotating hollow shaft that runs through hinged piece 210, while optional air line 204 is shown in this view. Wheel 205 is shown as is handle 207 joined to wheel 205, as well as belt 208. Rotation of the handle 207 turns wheel 205 and belt 208, turning the rotating hollow shaft and thus allowing the papers to be rotated about the conically shaped work piece 201 when in the lowered or rolling configuration. Receptacle 209 is shown as are folded papers 251. Hinge 250 is provided, allowing the user to pivot hinged piece 210 and use handle 211 to rotate the device including conically shaped work piece 201 out of the raised or loading configuration and into the lowered or rolling position, locating conically shaped work piece 201 proximate or "in" groove 212. Also shown in this view are notch 252 and markings 253, where notch 252 is used to receive and maintain pieces such as a crutch and/or filter, wherein the paper is wrapped around such items. Markings 253 are optional, but provide an orientation to align papers 251 prior to applying them to the conically shaped work piece 201. The entire apparatus may be secured to a surface or may be movable in some instances.

The depictions of FIGS. 1 and 2 are manually assisted devices, i.e. they need to be operated by an operator. Certain aspects of the design may be automated. For example, a pick-and-place apparatus or set of devices may be employed to attach filters or crutches to conically shaped work piece 201 and notch 252. Further, papers may have glue applied or be collected and positioned around conically shaped work piece 201 using devices, including but not limited to robotic arms or other devices. And while shown with handles 207 and 211, for example, such handles or parts to which these handles are attached may be rotated using a machine. Thus the present design may be partially or potentially completely automated.

Figure 3:
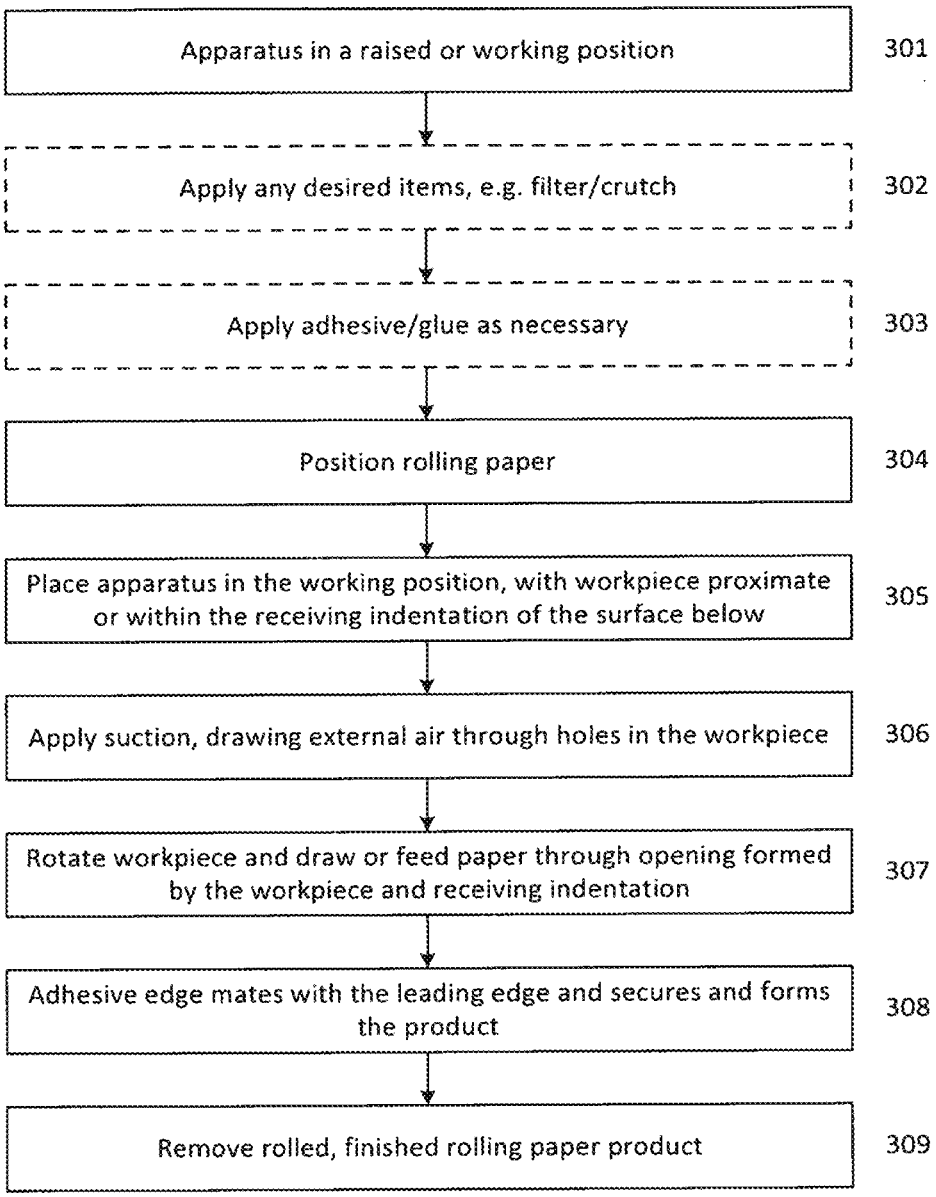
FIG. 3 is a functional flowchart of operation according to the present design.

FIG. 3 is a general overview of the processes used with the present teachings. More, fewer, or different processes may be employed. From FIG. 3, the device is placed in the raised or working position or orientation at point 301. The device is assumed to have the required materials, including papers, glues, and any crutches or filters desired. Point 302 calls for applying any desired items to the device, i.e. applying a crutch and/or filter to conically shaped work piece 201 or notch 252. Certain papers may include glue already applied thereto, typically along one edge of the paper. Glue is applied, if not already available with the rolling paper, at point 303. The user may apply glue to the paper or the paper may be drawn through or proximate a glue dispenser. Point 304 calls for obtaining and positioning the rolling paper or papers 251. Positioning may include placing the leading edge of the rolling paper proximate the conically shaped work piece 201, typically with the glued trailing edge positioned remotely, with the adhesive or glue side typically up. Such an orientation is shown in FIG. 4, and other orientations may be employed.

In one embodiment, positioning the rolling paper as shown by element 304 may precede application of adhesive or glue as indicated by point 303. The paper employed for this application tends to be light, on the order of 10 g/m2, and sometimes less. Such light paper can be more difficult to position or adjust once made wet or damp with the application of an adhesive activator or glue. Thus glue may be applied before or after positioning of the paper, and elements 303 and 304 in FIG. 3 may be reversed. The rolling paper may have glue or adhesive pre-applied and in some cases not pre-applied. If not pre-applied, glue or may be applied just before processing or rolling. In the case of pre-applied glue or adhesive, an activator may be applied to the paper to "wet" the dried pre-applied glue. The activator may be water or isopropyl alcohol or other formulations to activate the glue.

At point 305, the user may, or the apparatus may, position the apparatus in the working position, with workpiece proximate or within the receiving indentation of the surface below. Point 306 calls for the user or an automated device to cause suction to be applied, thus drawing air through holes or openings in the periphery or exterior of the sides of the conically shaped work piece 201. Point 307 calls for rotating conically shaped work piece 201, by the handles shown attached to the wheels of FIGS. 1 and 2 such as wheel 105 or possibly automatically. Such rotation in conjunction with suction applied causes the rolling paper to stay affixed to conically shaped work piece 201 and circle around conically shaped work piece 201 as conically shaped work piece 201 turns or rotates. At point 308, the adhesive or glued trailing edge mates with the free, leading edge under the rotating conically shaped work piece 201 and the adhesive or glue provided on the trailing edge of the rolling paper secures the trailing edge to the leading edge, forming the finished rolled paper. At point 309, the rolled, finished paper, including optional filter and/or crutch, is removed from the notch and conically shaped work piece 201. The completed paper may be provided to an individual, such as an end user or intermediary, who may fill the completed rolled paper with product.

Figure 4:
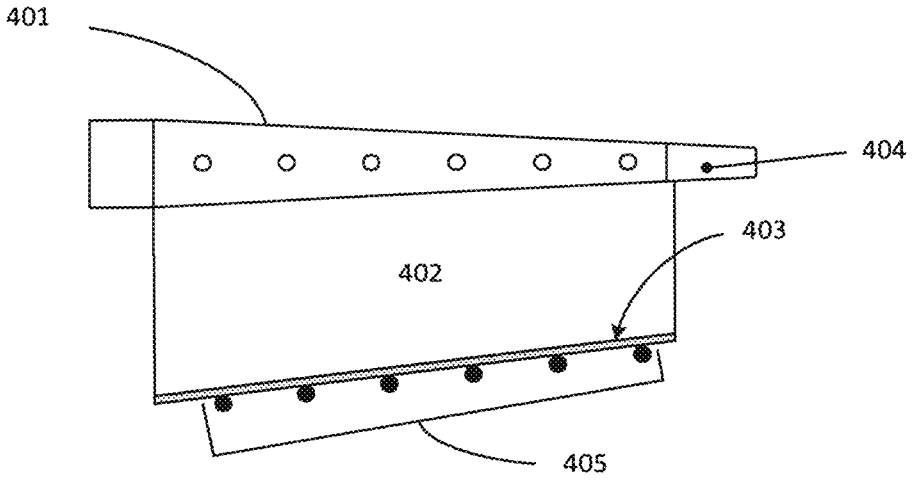
FIG. 4 illustrates a rolling paper positioned and prepared for assembly into a finished product.

From FIG. 4, the paper 402 is positioned proximate conically shaped work piece 401 with glue or adhesive 403 applied. Filter 404 has been applied to the conically shaped work piece 401. Again, the conically shaped work piece 401 is positioned proximate to or within the groove or receiving opening formed in the surface below. The user or apparatus may then apply suction, wherein air is drawn through the holes in conically shaped work piece 401. Markings 405 are provided to assist a user with alignment of the paper.

Figure 5:
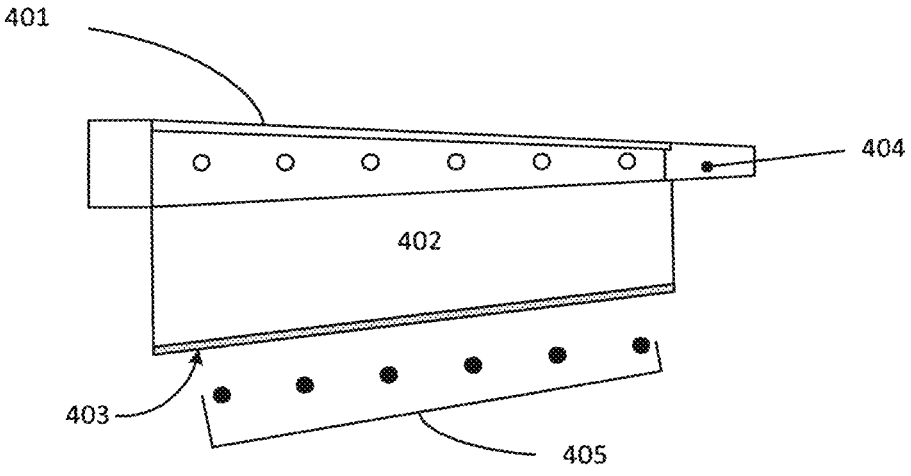
FIG. 5 shows rolling paper being drawn around the conically shaped work piece.
Figure 6:
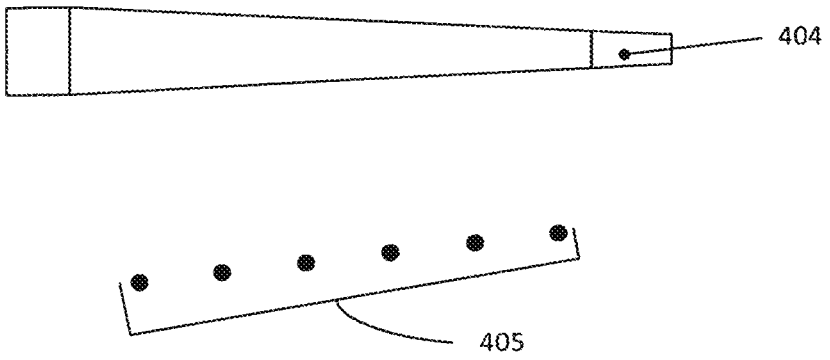
FIG. 6 shows the rolling paper completely wrapped around the work piece.
Figure 7:
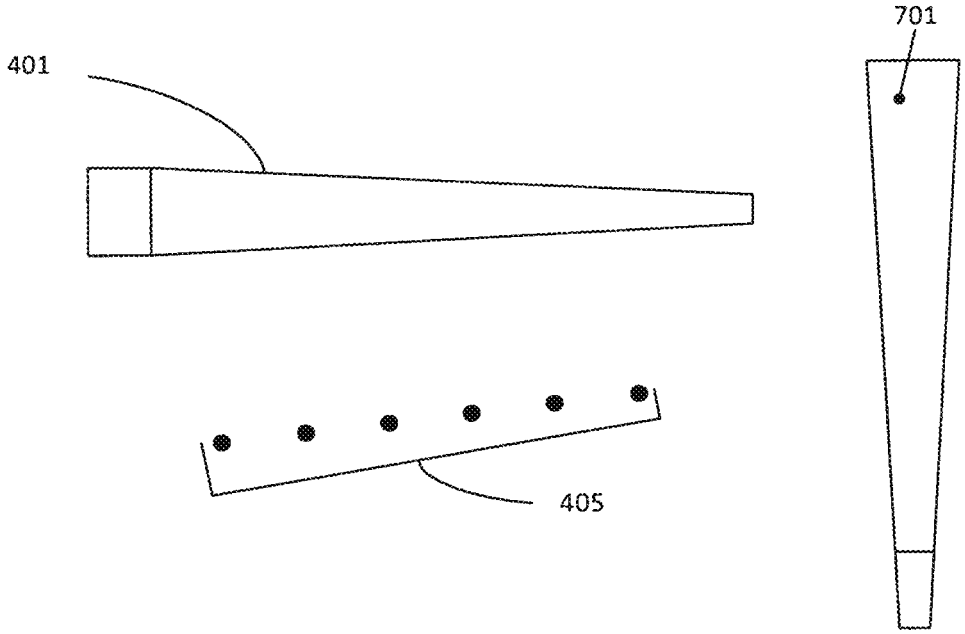
FIG. 7 shows the completed rolled paper, separated from the non-cylindrical work piece.

As may be appreciated, the holes in conically shaped work piece 401 may be positioned in various ways, such as a line on one side of conically shaped work piece 401 and a line of holes 180 degrees opposite, or may be graduated around the surface of the conically shaped work piece 401, or may be randomly spaced. Holes and suction are provided to ensure the rolling paper is drawn tightly and remains tightly drawn to the conically shaped work piece 401. FIG. 5 shows the paper being drawn around the conically shaped work piece 401 based on rotation of the wheel (not shown in this view), while FIG. 6 shows the paper completely wrapped around conically shaped work piece 401. In this view, the glue or adhesively line 403 is below the conically shaped work piece 401 and not shown, and this glue or adhesive line binds the trailing edge to the forward or leading edge of the rolling paper, such as resulting from pressure applied between conically shaped work piece 401 and the groove or receiving opening below. FIG. 7 shows the completed rolled paper 701, separated from conically shaped work piece 401 and in this view including optional filter 404.

Thus in accordance with the present design, a paper may be provided in a non-cylindrical shape using a shaped workpiece offering openings and suction provided through the openings. In one aspect, papers are provided in a preferred orientation proximate a workpiece, such as with glue attached to the trailing end, and the workpiece is rotated while suction is applied to the workpiece and through a series of holes to hold the paper in place while the paper is wound about the workpiece. Such a device and method may be automated in whole or in part and may be user operated. As an example, the device may be oriented such that the filter is applied to the conically shaped work piece vertically, at the bottom of conically shaped work piece, the papers fed in a sideways orientation, and when completed and suction removed, the completed paper and filter may drop into a collection bin or onto a conveyor belt. Other automated attributes may be employed in realizing a completed non-cylindrical paper end product.

Such an apparatus may be successfully employed with very thin papers. The present design can accommodate, for example, rolling papers on the order of 10 g/m$^2$, and sometimes less. Typical existing cigarette producing machines would likely tear papers of this weight.

While described herein with an emphasis on the rotatable non-cylindrical workpiece employing holes and suction to draw the paper to the workpiece, other constructs are possible. One other way of drawing the paper toward the workpiece employs static charge, wherein the system applies a charge of one polarity, such as positive charge, to the rotating non-cylindrical portion and a charge of opposite polarity, such as negative charge, to the rolling paper as the rolling paper is positioned proximate the rotatable non-cylindrical workpiece. In such an embodiment, vacuum holes and suction are not needed or may be optionally provided in addition to static charge. Further, the rolling papers may be charged when separate from the device and then placed in the device, such as having a charged receptacle holding the rolling papers, or the charge may be applied to an uncharged rolling paper from a device or devices located at the machine. An electrical charging bar or strip may be provided near the rotatable non-cylindrical workpiece when in the working position such that passing the paper over such a bar or strip causes the rolling paper to acquire charge of one polarity while the workpiece, located separate from the bar, is provided with charge of opposite polarity.

According to an embodiment of the present design, there is provided an apparatus for rolling papers into a non-cylindrical orientation. The apparatus includes a rotatable non-cylindrical workpiece having a plurality of openings provided therein, a surface comprising a receiving indentation configured to receive and fit the rotatable non-cylindrical workpiece, a suction producing arrangement connected to the rotatable non-cylindrical workpiece, and a rolling paper. The suction producing arrangement draws air through the plurality of openings while the rotatable non-cylindrical workpiece rotates such that the drawn air draws the rolling paper toward and around the rotatable non-cylindrical workpiece, the rotation causing the rolling paper and a quantity of adhesive applied to the rolling paper to form a completed non-cylindrical rolling paper product.

In a further embodiment of the present design, there is provided an apparatus for rolling papers into a non-cylindrical orientation, comprising a rotatable non-cylindrical workpiece having a plurality of openings provided therein, wherein the rotatable non-cylindrical workpiece is generally frustrum shaped, a surface comprising a receiving indentation configured to receive and shaped to accommodate the rotatable non-cylindrical workpiece, a suction producing arrangement connected to the rotatable non-cylindrical workpiece, and a rolling paper. The suction producing arrangement draws air through the plurality of openings while the rotatable non-cylindrical workpiece rotates such that drawn air serves to draw the rolling paper toward and around the rotatable non-cylindrical workpiece, resulting in a leading edge of the rolling paper binding with an adhesive applied to a trailing edge of the rolling paper.

In another embodiment of the design, there is provided an apparatus for rolling papers into a non-cylindrical product, comprising a non-cylindrical workpiece having a plurality of openings formed therein, a surface comprising a receiving indentation configured to receive and shaped to accommodate the non-cylindrical workpiece, a suction producing arrangement connected to the non-cylindrical workpiece, and a rolling paper. The suction producing arrangement is configured to draw external air through the plurality of openings while the non-cylindrical workpiece rotates such that drawn air serves to draw the rolling paper toward and around the rotatable non-cylindrical workpiece, resulting in a leading edge of the rolling paper binding with an adhesive applied to a trailing edge of the rolling paper.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. An apparatus for rolling papers into a non-cylindrical orientation, comprising:

a rotatable non-cylindrical workpiece having a non-cylindrical peripheral outer side surface having a plurality of openings provided therein;

a surface comprising a receiving indentation configured to receive and fit the non-cylindrical peripheral outer side surface of the rotatable non-cylindrical workpiece;

a suction producing arrangement connected to the rotatable non-cylindrical workpiece; and a rolling paper;

wherein the suction producing arrangement draws air through the plurality of openings while the rotatable non-cylindrical workpiece rotates with the non-cylindrical peripheral outer side surface positioned within the receiving indentation in the surface such that the drawn air draws the rolling paper toward and around the rotatable non-cylindrical workpiece, the rotation causing the rolling paper and a quantity of adhesive applied to the rolling paper to form a completed non-cylindrical rolling paper product.

2. The apparatus of claim 1, wherein the rolling paper comprises a leading edge and a trailing edge, and the adhesive product is applied to the trailing edge.

3. The apparatus of claim 2, wherein the adhesive product applied to the trailing edge contacts the leading edge when the rolling paper is positioned around the non-cylindrical workpiece, binding the trailing edge to the leading edge.

4. The apparatus of claim 1, further comprising a filter or crutch positioned proximate a remote end of the rotatable non-cylindrical workpiece, wherein the rolling paper forms the completed non-cylindrical rolling paper product about the filter or crutch.

5. The apparatus of claim 1, wherein the rolling paper passes through an opening formed between the rotatable non-cylindrical workpiece and the receiving indentation.

6. The apparatus of claim 1, wherein the rotatable non-cylindrical workpiece is provided with a hinged element configured to enable the raising and lowering of the rotatable non-cylindrical workpiece into and out of proximity with the receiving indentation.

7. The apparatus of claim 1, wherein the rotatable non-cylindrical workpiece is generally frustum shaped.

8. An apparatus for rolling papers into a non-cylindrical orientation, comprising:

a rotatable non-cylindrical workpiece having a non-cylindrical peripheral outer side surface having a plurality of openings provided therein, wherein the rotatable non-cylindrical workpiece is generally frustrum shaped;

a surface comprising a receiving indentation configured to receive and shaped to accommodate the non-cylindrical peripheral outer side surface of the rotatable non-cylindrical workpiece;

a suction producing arrangement connected to the rotatable non-cylindrical workpiece; and a rolling paper;

wherein the suction producing arrangement draws air through the plurality of openings while the rotatable non-cylindrical workpiece rotates with the non-cylindrical peripheral outer side surface positioned within the receiving indentation in the surface such that drawn air serves to draw the rolling paper toward and around the rotatable non-cylindrical workpiece, resulting in a leading edge of the rolling paper binding with an adhesive applied to a trailing edge of the rolling paper.

9. The apparatus of claim 8, wherein the adhesive product comprises glue.

10. The apparatus of claim 8, wherein the adhesive product on the trailing edge contacts the leading edge when the rolling paper is around the non-cylindrical workpiece, binding the trailing edge to the leading edge.

11. The apparatus of claim 8, further comprising a filter or crutch positioned proximate a remote end of the rotatable non-cylindrical workpiece, wherein the rolling paper forms a completed non-cylindrical rolling paper product about the filter or crutch.

12. The apparatus of claim 8, wherein the rolling paper passes through an opening formed between the rotatable non-cylindrical workpiece and receiving indentation.

13. The apparatus of claim 8, wherein the rotatable non-cylindrical workpiece is provided with a hinged element configured to enable the raising and lowering of the rotatable non-cylindrical workpiece into and out of proximity with the receiving indentation.

14. The apparatus of claim 8, wherein the rolling paper has a weight of 10 $g/m^2$ or less.

15. An apparatus for rolling papers into a non-cylindrical product, comprising:

a non-cylindrical workpiece having a non-cylindrical peripheral outer side surface having a plurality of openings formed therein;

a surface comprising a receiving indentation configured to receive and shaped to accommodate the non-cylindrical peripheral outer side surface of the non-cylindrical workpiece;

a suction producing arrangement connected to the non-cylindrical workpiece; and a rolling paper;

wherein the suction producing arrangement is configured to draw external air through the plurality of openings while the non-cylindrical workpiece rotates with the non-cylindrical peripheral outer side surface positioned within the receiving indentation in the surface such that drawn air serves to draw the rolling paper toward and around the rotatable non-cylindrical workpiece, resulting in a leading edge of the rolling paper binding with a trailing edge of the rolling paper.

16. The apparatus of claim 15, wherein the non-cylindrical workpiece is generally frustum shaped and rotatable.

17. The apparatus of claim 16, further comprising a filter or crutch positioned proximate a remote end of the non-cylindrical workpiece, wherein the rolling paper forms a completed non-cylindrical rolling paper product about the filter or crutch.

18. The apparatus of claim 16, wherein the rolling paper passes through an opening formed between the non-cylindrical workpiece and receiving indentation.

19. The apparatus of claim 16, wherein the non-cylindrical workpiece is provided with a hinged element configured to enable the raising and lowering of the non-cylindrical workpiece into and out of proximity with the receiving indentation.

20. The apparatus of claim 8, wherein the rolling paper has a weight of 10 $g/m^2$ or less.

* * * * *